US005810660A

United States Patent [19]

Lee

[11] Patent Number: 5,810,660

[45] Date of Patent: Sep. 22, 1998

[54] OPERATIONAL CONTROL APPARATUS FOR AN AIR CONDITIONER AND CONTROL METHOD THEREFOR

[75] Inventor: Gab-Youl Lee, Suwon, Rep. of Korea

[73] Assignee: Samsung Electronics Co., Ltd., Suwon, Rep. of Korea

[21] Appl. No.: 850,236

[22] Filed: May 2, 1997

[30] Foreign Application Priority Data

Aug. 28, 1996 [KR] Rep. of Korea ..... 96-36086

[51] Int. Cl.[6] ..... F24F 13/20

[52] U.S. Cl. ..... 454/233; 454/315; 454/319; 454/324

[58] Field of Search ..... 454/202, 229, 454/233, 234, 256, 259, 315, 318, 319, 320, 321, 324, 334

[56] References Cited

U.S. PATENT DOCUMENTS 5,388,426 2/1995 Wada et al. ..... 62/263
5,461,875 10/1995 Lee et al. ..... 454/324 X

*Primary Examiner*—Harold Joyce
*Attorney, Agent, or Firm*—Burns, Doane, Swecker & Mathis, L.L.P.

[57] ABSTRACT

An air conditioner includes an air inlet, an air outlet, and a heat exchanger disposed therebetween. Adjustable blades extend across the outlet for controlling the direction of travel of air through the outlet. A door is movable for opening and closing the outlet. A timer counts a time interval following the input of an operation start signal or an operation stop signal and prevents the air conditioner from being started or stopped until a predetermined interval has elapsed. Following the elapse of the time interval, and before the opening or closing of the door, the blades are moved to an out-of-the-way position to avoid obstructing the movement of the door.

2 Claims, 13 Drawing Sheets

OPERATIONAL CONTROL APPARATUS FOR AN AIR CONDITIONER AND CONTROL METHOD THEREFOR

BACKGROUND OF THE INVENTION

1. Field of the Invention

This invention relates to an air conditioner for opening and closing an inlet and an outlet thereof for preventing dust or harmful materials from incoming therethrough.

2. Description of the Prior Art

As shown in FIGS. 1 and 2, an indoor unit 1 of a conventional air conditioner has an inlet grill member 5 including a plurality of inlets 3 through which room air is sucked at a frontal lower part thereof and has outlet 7 formed at a frontal upper part thereof for discharging the air heat-exchanged as cold wind or hot wind after being sucked through the inlet 3.

Further, there are installed at the outlet 7 horizontal blades 9 for vertically controlling the direction of the air discharged through the outlet 7 and vertical blades 11 for horizontally controlling a direction of the air. There is installed inside the outlet 7 an outlet door 13 to open the outlet 7 so that the air heat-exchanged in a heat exchanger (not shown) is discharged into a room smoothly and to close the outlet 7 both for preventing dust and harmful materials from flowing into the indoor unit 1 during an operation stand-by condition and for improving an external appearance thereof.

A cover member 15 is fixed at a frontal part of the indoor unit 1 both for design purposes and for protecting inner elements of the apparatus; and a control panel 17 is equipped at a lower side of the cover member 15 for selecting operational modes (auto, cooling, defrosting, air blowing, heating or the like), start/stop operation, discharge amount and wind directions of the air discharged through the outlet 7 of the air conditioner.

As shown in FIG. 3, drive means for vertically moving the outlet door 13 includes a support member 19 fixed at a frontal upper part of the indoor unit 1, an outlet motor 21 fixed by the support member 19 for generating torque for vertically moving the outlet door 13, a pinion 23 coupled with a shaft 22 of the outlet motor 21 to be revolved by the outlet motor 21, and a rack 25 engaged with the pinion 23 to vertically move the outlet door 13 by changing revolutionary movement of the pinion 23 to linear movement of the outlet door 13 when the pinion 23 is revolved.

In addition, drive means for rotating the horizontal blade 9 comprises a wind direction control motor 27 (e.g. a stepping motor) installed inside the indoor unit 1 and a plurality of link members 29 operated in accordance with revolutions of the wind direction control motor 27 to thereby rotate the plurality of horizontal blade 9 simultaneously.

In an air conditioner as constructed above, when a user selects an operational mode by manipulating a remote controller or a control panel 17 and turns on a start/stop key (hereinafter referred to as "start key"), the outlet motor 21 is driven in a normal direction. Then, the pinion 23 coupled with the shaft 22 of the outlet motor 21 is revolved and the rack 25 engaged therewith is moved downward, so that the outlet door 13 coupled with the rack 25 descends to open the outlet 7.

At this time, if a door open/close detecting sensor attached at a location above or below the outlet 7 detects a complete opening of the outlet 7, the outlet motor 21 stops and an indoor fan (not shown) is revolved to suck the room air into the indoor unit 1 of the air conditioner through the inlet 3. And the air inhaled through inlet 3 passes through a heat exchanger not shown and is heat-exchanged by latent evaporative heat of coolant flowing in the heat exchanger.

The air heat exchanged through the heat-exchanger is guided upward and is discharged into the room through the outlet 7. The discharged air direction is controlled in accordance with angles of the horizontal blades 9 and vertical blades 11 to thereby accomplish the air-conditioning of the room.

A method of the prior art to vertically adjust a discharging direction of the air using the horizontal blades 9 is to twice manipulate an operational key equipped at the control panel 17 for operating the horizontal blades 9 to an "on" position. That is, if the key is manipulated one time at its on-position, the wind direction motor 27 is driven and the plurality of link members 29 are consecutively operated to swing the horizontal blades 9. And when the operational key is manipulated once again at its on-position, it turns off the wind direction motor 27 and stops the horizontal blades 9.

If a user turns off the operational key during the normal operation of the air conditioner as above, the outlet motor 21 is driven reversely. Then the pinion 23 is operated to move the rack 25 upward to thereby elevate the outlet door 13 and close the outlet 7.

However, there is a problem in the air conditioner manipulated by the method described above, in that driving elements such as compressor, indoor fan and the like are always driven immediately in response to the ON or OFF manipulation of the operational key. Accordingly, if the operational key is frequently manipulated by mistake or by mischievous children, it constitutes one of the reasons for generating noises and reducing the life of driving elements and the air conditioner as well.

Further, there is another problem in the conventional air conditioner in that dust and harmful materials enter the indoor unit 1 through the always-open inlet 3 and stick on surfaces of the heat exchanger to thereby decrease efficiency of the heat exchanger.

Further, there is still another problem in the conventional air conditioner in that unnatural opening or closing movement of the outlet door 13 can cause breakage and abnormal operation of the apparatus. That is because the wind direction motor 27 stops its operation and orients the horizontal blades 9 in random positions when the air conditioner is rendered to be inoperative, so that the outlet door 13 interferes with the horizontal blades 9 when the outlet door 13 is opened or closed.

Accordingly, it is an object of the present invention to provide an operational control apparatus of an air conditioner and method therefor which can prevent intermittent operation of driving elements according to frequent on/off manipulations to thereby reduce noises and prolong the life of the air conditioner and driven elements at the same time.

It is another object of the present invention to provide an operational control apparatus of an air conditioner and method therefor which eliminates interference between the horizontal blades and the outlet door by rotating the horizontal blades upward before opening or closing the outlet so as to facilitate opening and closing movement of the outlet door.

It is still another object of the present invention to provide an operational control apparatus of an air conditioner and method therefor which can effectively control the wind direction of discharged air by positioning wind direction guiding blades centrally when the outlet becomes open.

SUMMARY OF THE INVENTION

The above and other objects are achieved by an operational control apparatus of an air conditioner according to the present invention, the apparatus comprising an inlet for inhaling room air; a heat exchanger for conditioning the air inhaled through the inlet; an outlet for discharging the air heat-exchanged in the heat exchanger; wind direction guiding blades for controlling wind direction of the air discharged through the outlet; and an outlet door opening and closing the outlet for preventing dust and harmful materials from being flowed into the outlet, wherein the apparatus further comprises:

an inlet grill for opening and closing the inlet for preventing dusts and harmful materials from being flowed into the inlet;

operation manipulating means for inputting start and stop signals to open and close the inlet and the outlet are respectively input;

control means for controlling open and close operation of the inlet and outlet by counting signal input interval when a start or stop signal is input;

drive means for wind direction guiding blades for upward rotating the wind direction guiding blades when the start or stop signal is input from the operation manipulating means so that the opening and closing movement of the outlet door becomes smooth; and open/close driving means for opening or closing the outlet door and the inlet grill.

The operational control method of an air conditioner according to the present invention comprises the steps of:

identifying whether a start or stop signal is input from operation manipulating means;

counting a signal input interval if a start or stop signal is input and determining whether a predetermined time interval has elapsed;

rotating a wind direction guiding blades upward when the signal input interval has passed the predetermined time interval;

opening and closing the inlet and the outlet by controlling the drive means when the wind direction guiding blades are rotated upward;

controlling wind direction of the discharged air by positioning the wind direction guiding blades oriented in the center when both the inlet and the outlet are opened; and accomplishing the air conditioning by discharging the air to the room according to the established temperature and the established amount of wind.

BRIEF DESCRIPTION OF THE DRAWINGS

For a fuller understanding of the nature and objects of the invention, reference should be made to the following detailed description taken in conjunction with the accompanying drawings in which.

DESCRIPTION OF THE PREFERRED EMBODIMENT

Figure 1:
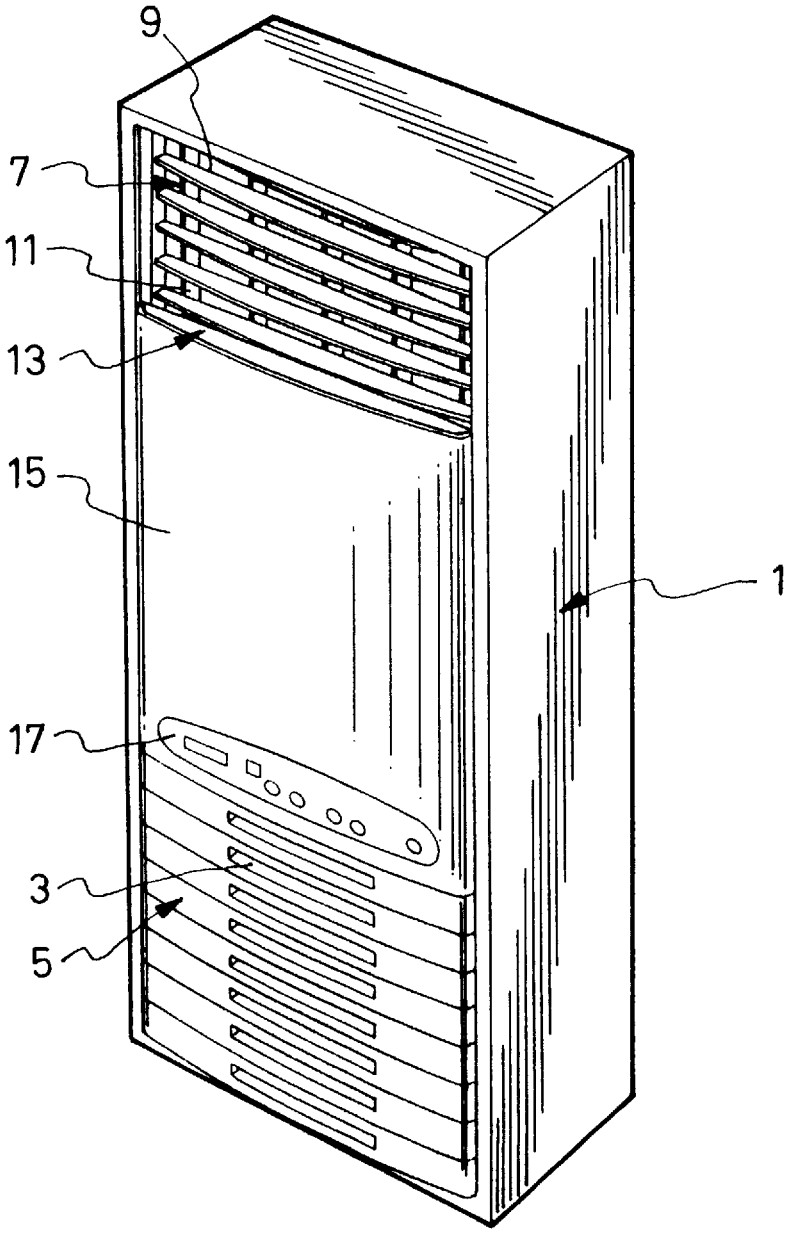
FIG. 1 (PRIOR ART)
FIG. 1 is a top front perspective view showing an air conditioner according to the prior art where an outlet is open.
Figure 2:
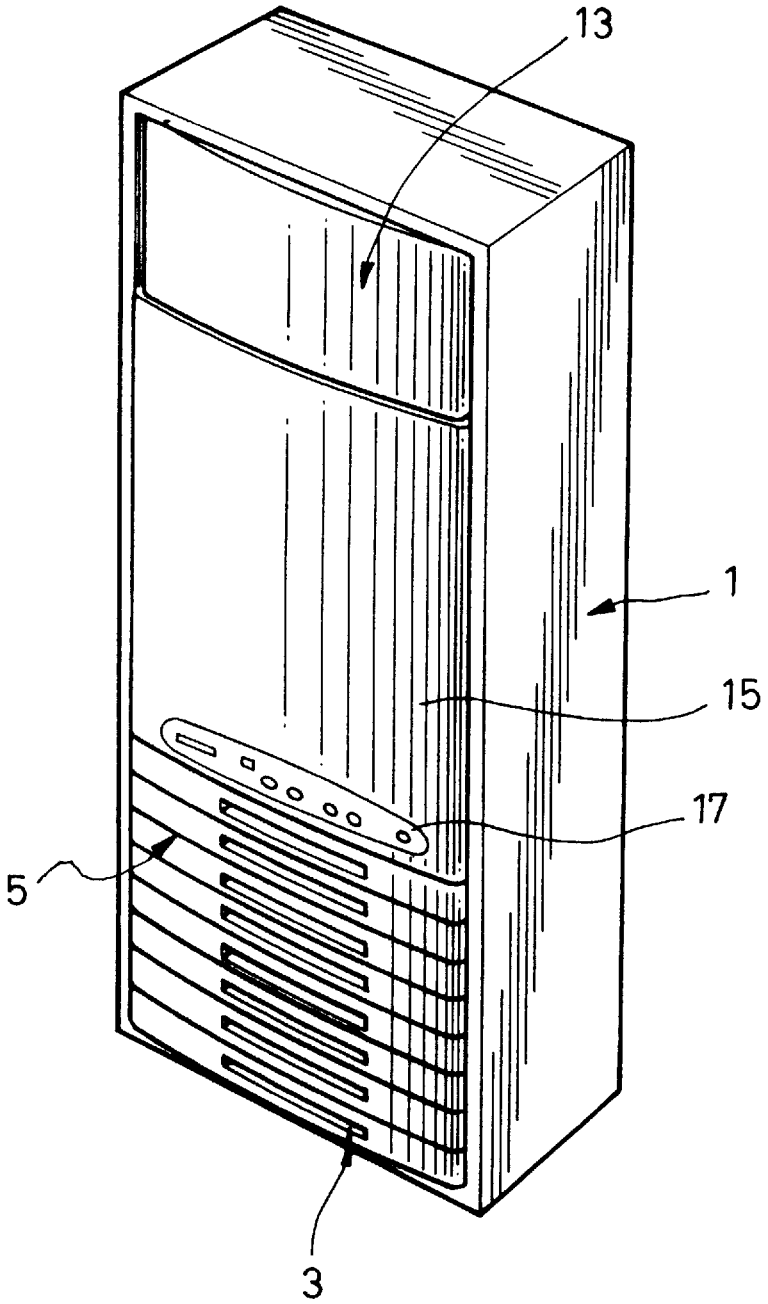
FIG. 2 (PRIOR ART)
FIG. 2 is a view of the air conditioner of FIG. 1 where the outlet is closed.
Figure 3:
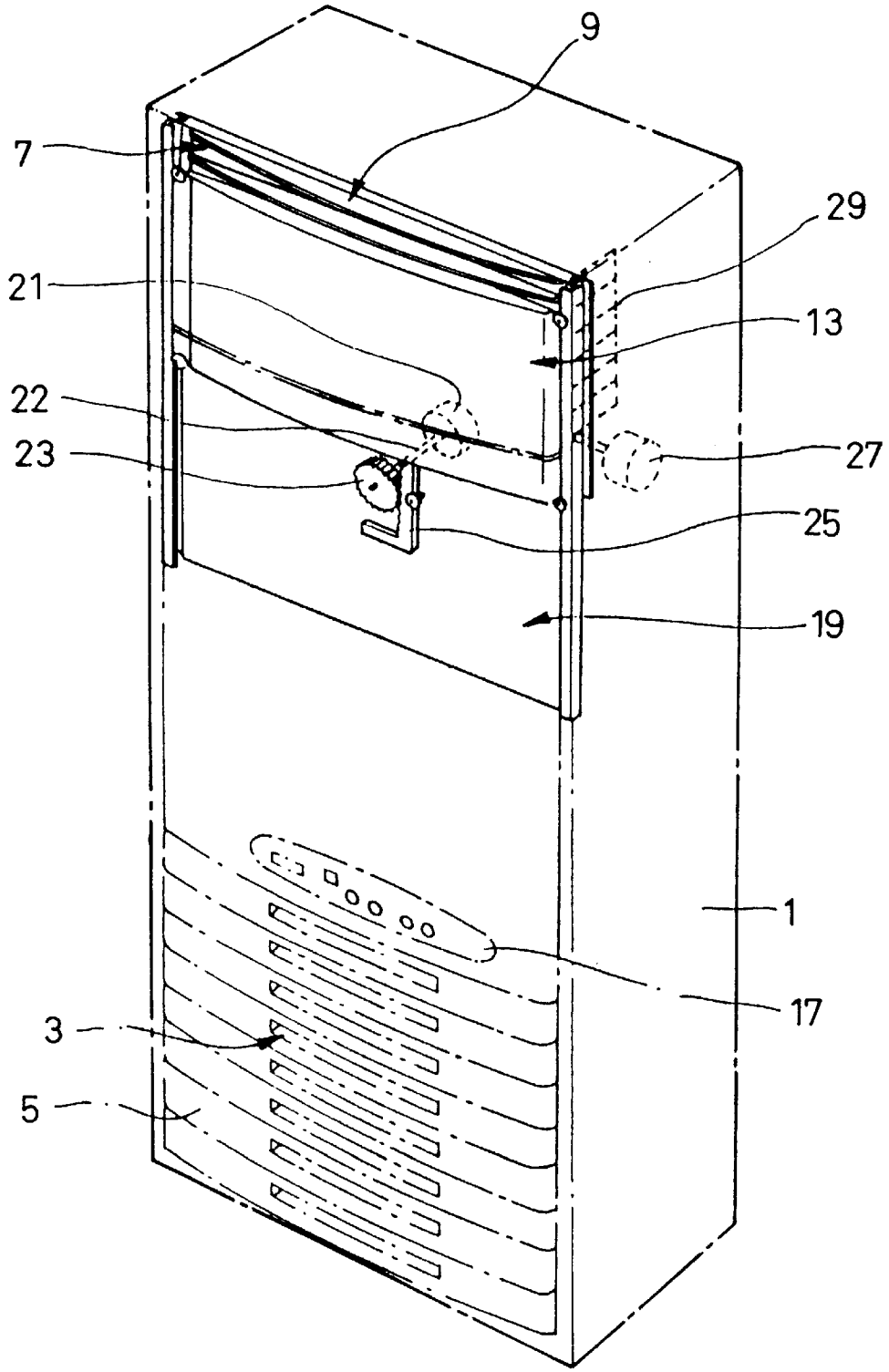
FIG. 3 (PRIOR ART)
FIG. 3 is a perspective view schematically showing an inner construction of the air conditioner of FIG. 1.

A preferred embodiment of the present invention will now be described in detail with reference to the accompanying drawings.

Throughout the drawings, like reference numerals are used for designating of like elements or parts similar to those of the air conditioner of the prior art and the repeated description thereof will be omitted for simplicity of illustration and explanation.

Figure 4:
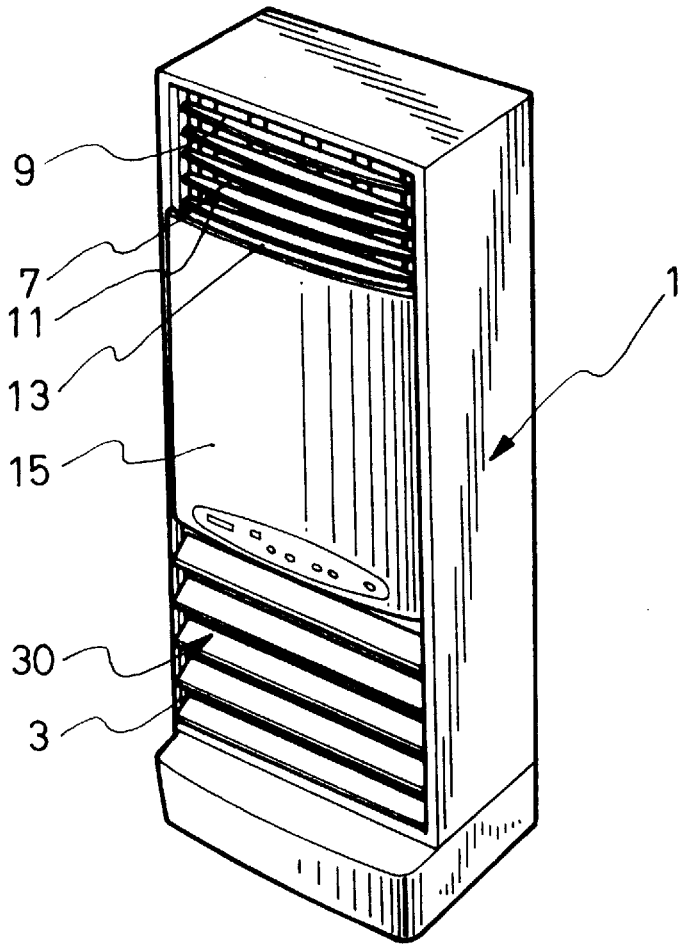
FIG. 4 is a top front perspective view showing an air conditioner according to an embodiment of the present invention.

As shown in FIG. 4, inlet open/close means 30 is installed at an inlet 3 formed at a lower part of an indoor unit 1 to open the inlet 3 so that the room air can be inhaled smoothly through the inlet 3 upon operating an air conditioner, and to close the inlet 3 so that dusts and harmful materials can be prevented from entering the indoor unit 1 and at the same time to provide an aesthetic appearance while the air conditioner is in a stand-by condition (not operated).

Figure 5:
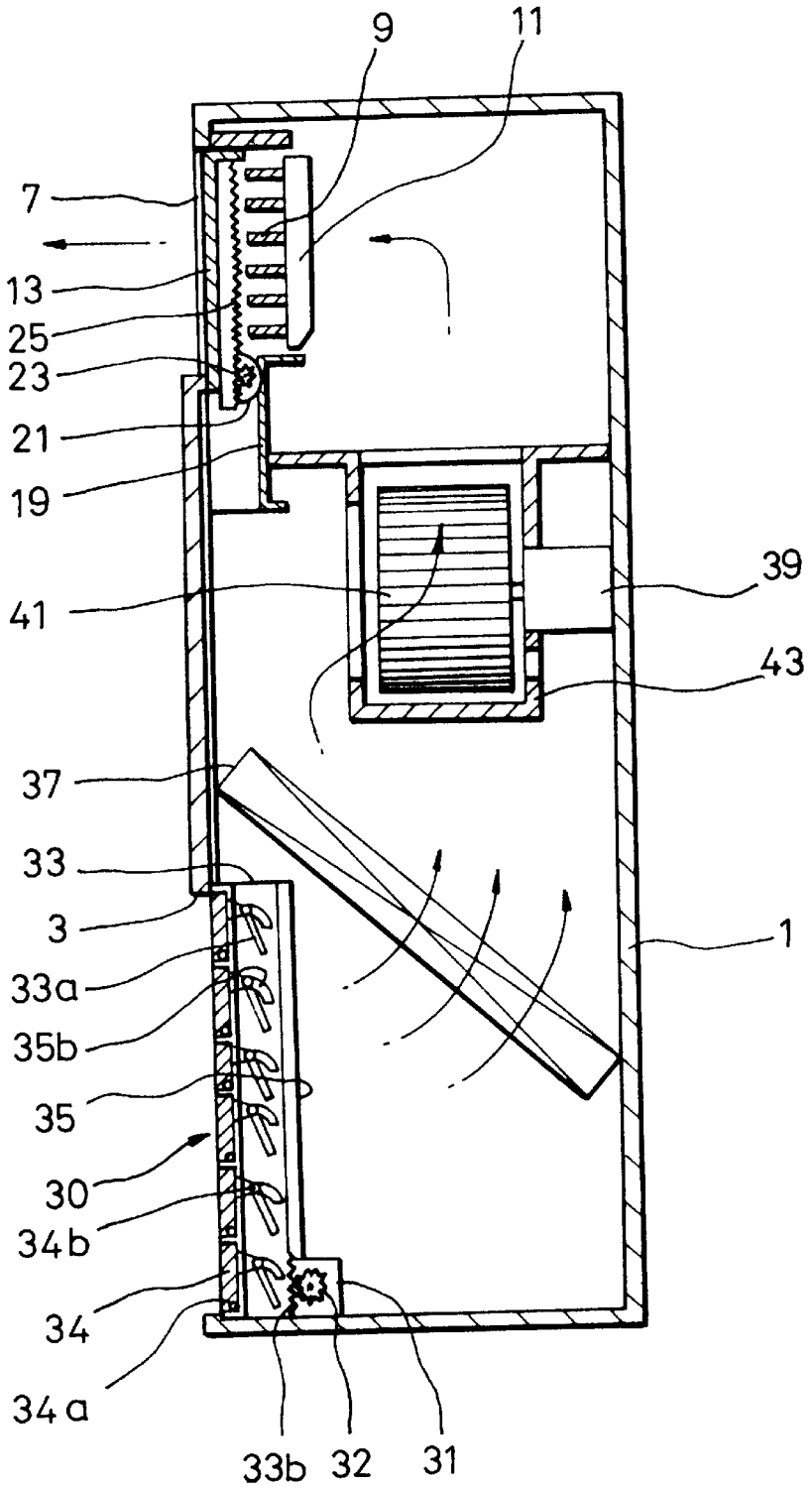
FIG. 5 is a vertical cross sectional view showing the air conditioner of FIG. 4 where an inlet and an outlet are closed.

As shown in FIG. 5, the inlet open/close means 30 comprises an inlet motor 31 for generating a driving torque for opening or closing the inlet 3; a pinion for being rotated forward or backward by torque transmitted from the inlet motor 31, a slide member 33 engaged with the pinion 32 and moving upward or downward according to a rotational orientation of the pinion 32; an inlet grill 34 formed by blades linked with the slide member 33 and rotated according to translational movement of the slide member 33; and guide members 35 installed at both side ends of the inlet grill 34 for supporting the inlet grill 34 to rotate freely and at the same time for guiding the inlet grill 34 to be opened or closed.

A heat exchanger 37 is installed downstream of the inlet open/close means 30 in order to heat-exchange the room air inhaled through the inlet 3 as cold wind or hot wind by latent evaporative heat, and an indoor fan 41 driven by an indoor fan motor 39 is installed over the heat exchanger 37 for inhaling the room air through the inlet 3 and at the same time for discharging the air to the room through the outlet 7.

Further, a duct 43 is installed around the indoor fan 41 in order to cover the indoor fan 41 and at the same time to guide the air flow inhaled through the inlet 3 and discharged to room through the outlet 7.

Figure 6:
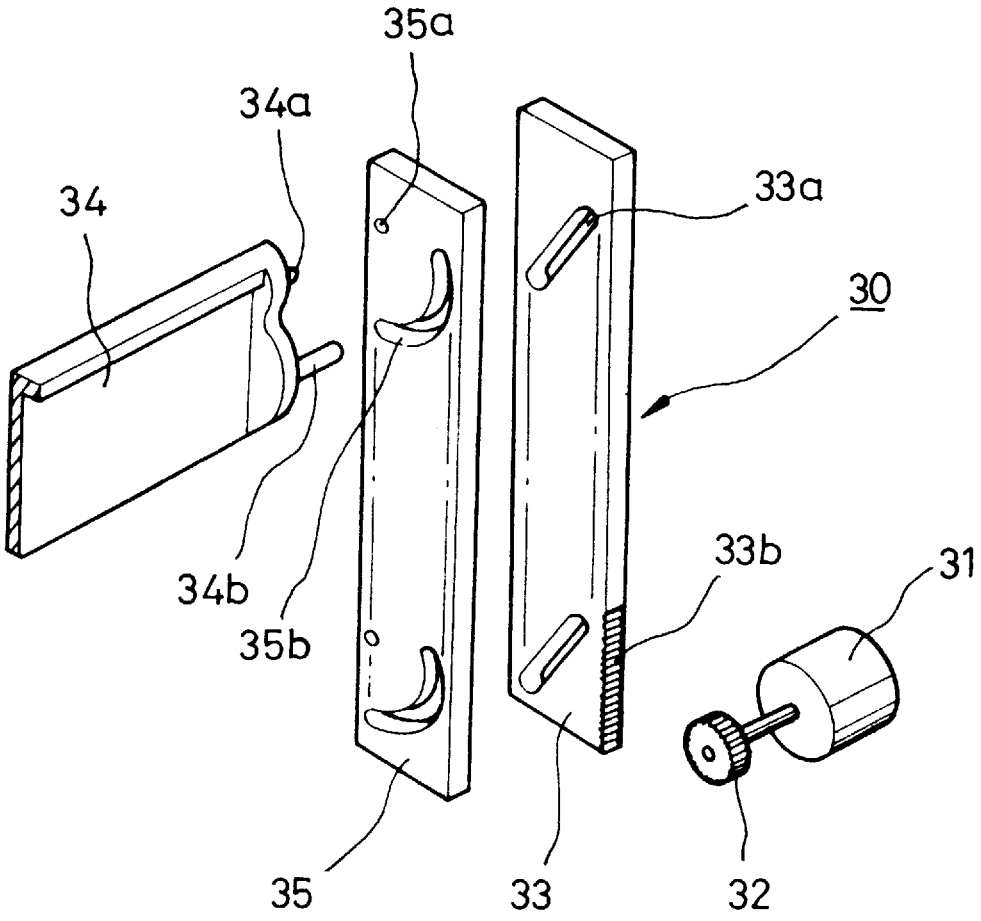
FIG. 6 is a perspective exploded view showing principal elements according to the present invention.

As shown in FIG. 6, hinge shafts 34*a* for supporting the inlet grill 34 to revolve freely are installed at both side ends of the inlet grill 34, and protrusions 34*b* formed at a side of the hinge shaft 34*a* are disposed in and rotated by a groove 33*a* formed in the slide member 33.

In addition, a fixing hole 35*a* to retain the hinge shafts 34*a* for freely revolving is formed in a guide member 35, and an arch-shaped guide hole 35*b* is formed next to the fixing hole 35*a* so that the protrusions 34*b* rotate in accordance with the translational movement of the slide member 33, and a gear rack 33*b* is formed in an edge of the slide member 33 to be engaged with the pinion 32.

An electric circuit to control an open/close operation of the outlet door 13 and a vertical movement of the horizontal blades 9 in the air conditioner structured as above will be explained with reference to FIGS. 7 and 8.

Figure 7:
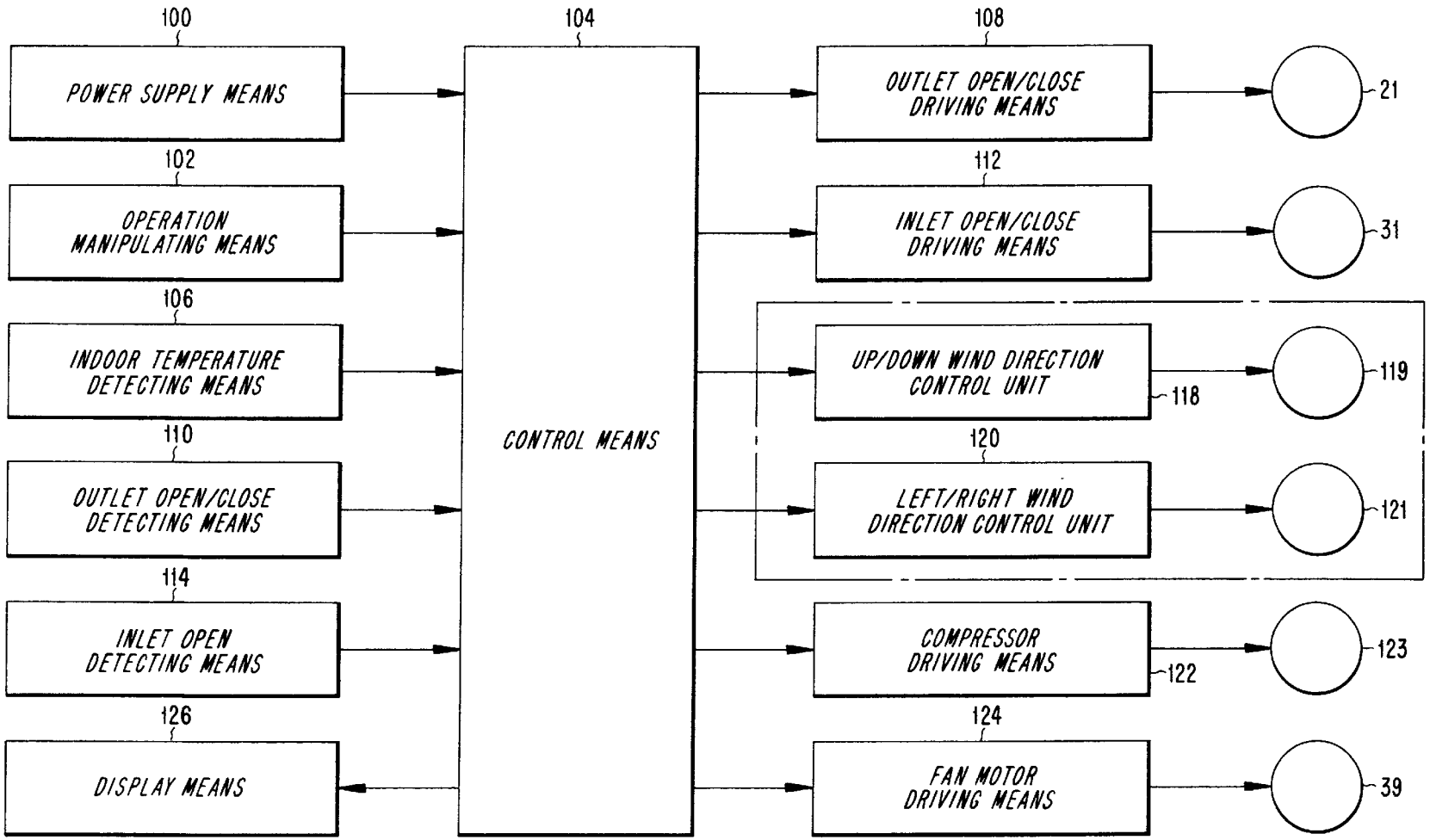
FIG. 7 is a control block diagram of an operational control apparatus according to the embodiment of the present invention.
Figure 8:
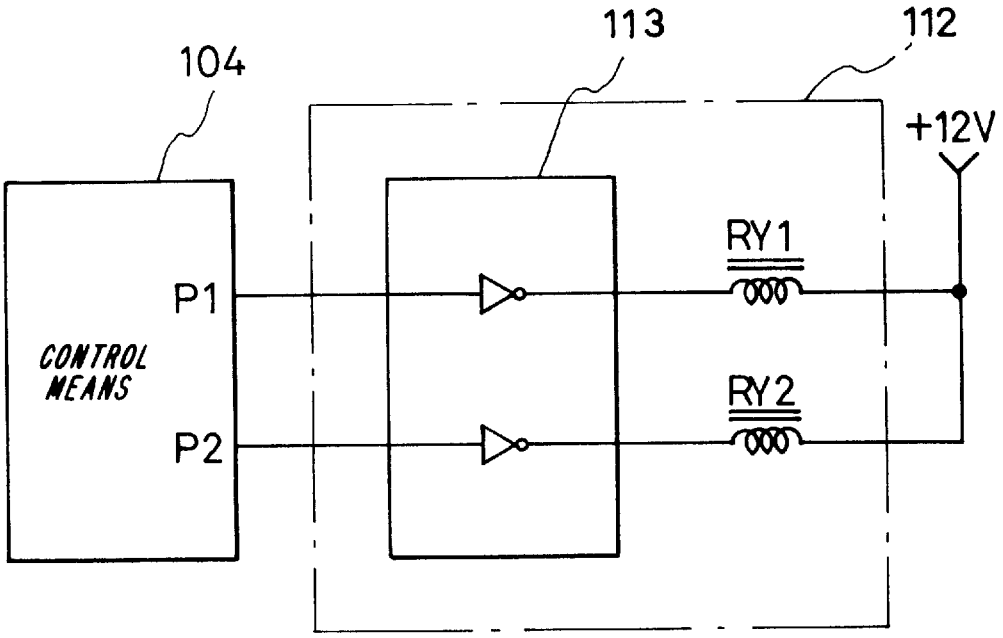
FIG. 8 is an electric circuit of inlet open/close driving means according to the present invention.
Figure 8:
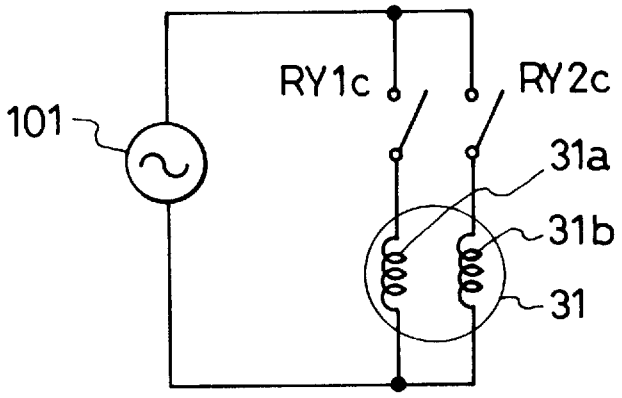
Figure 9A:
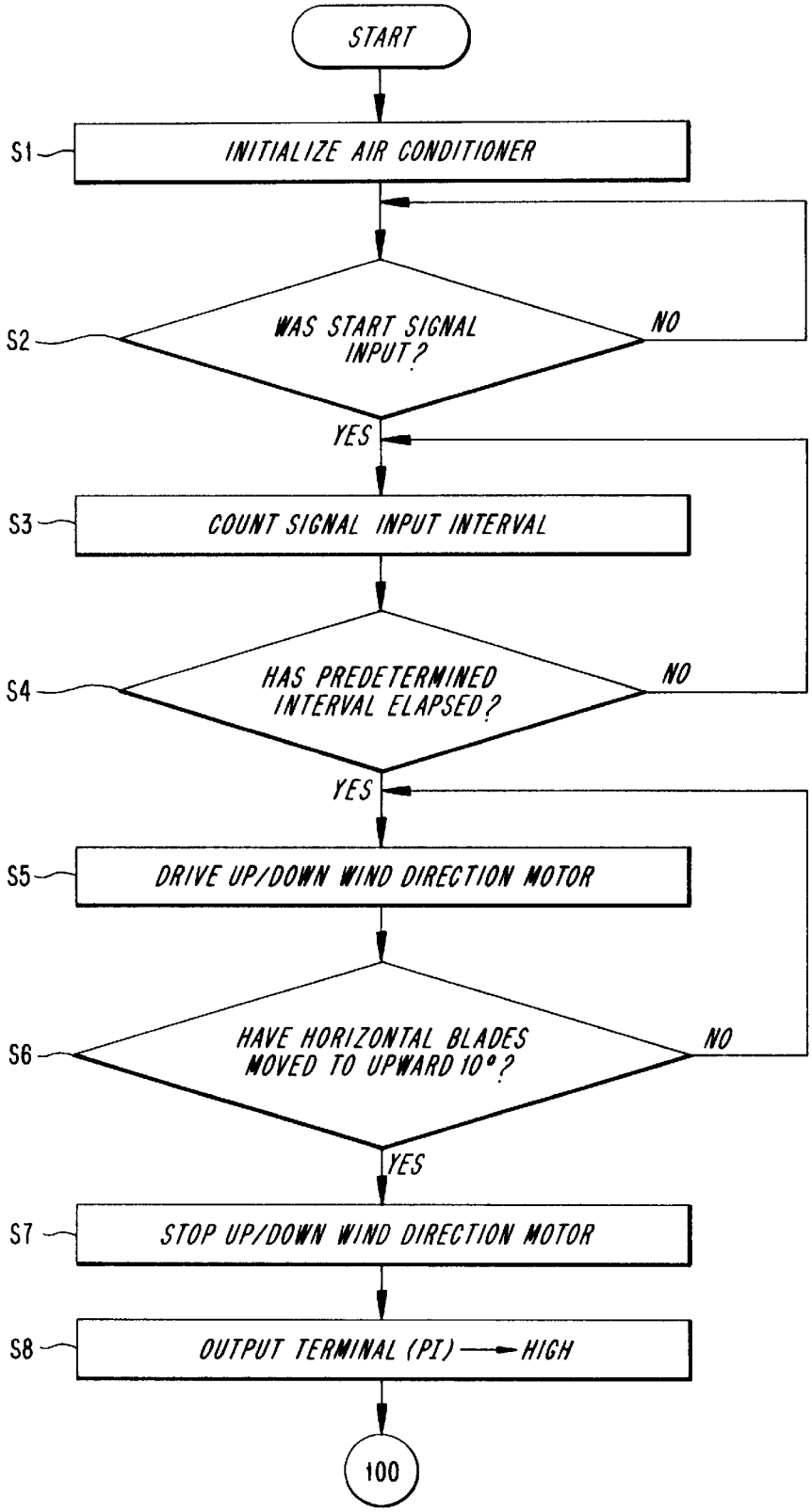
FIGS. 9A to 9E are flow charts respectively showing operational sequences of an air conditioner according to the present invention.
Figure 9B:
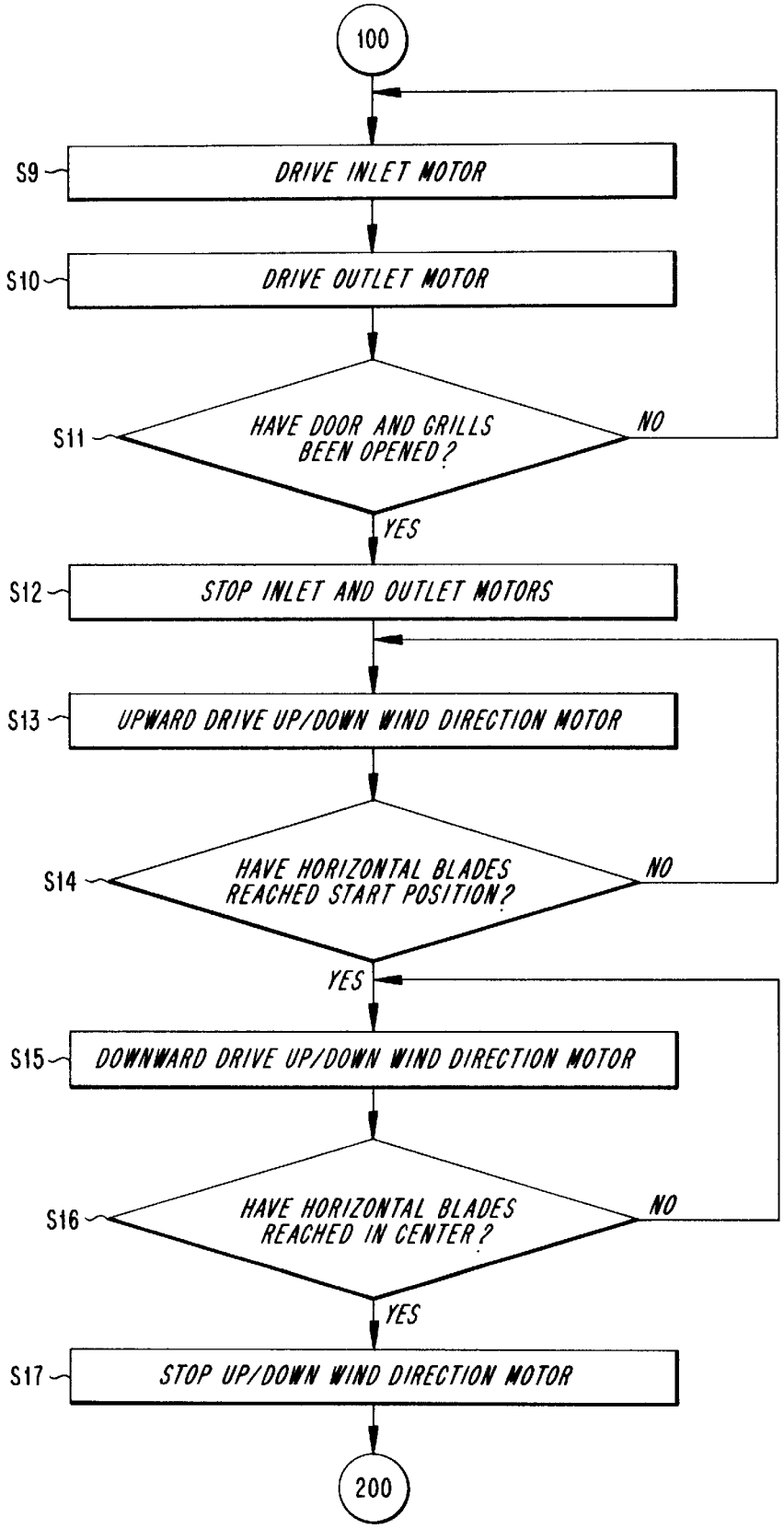
Figure 9C:
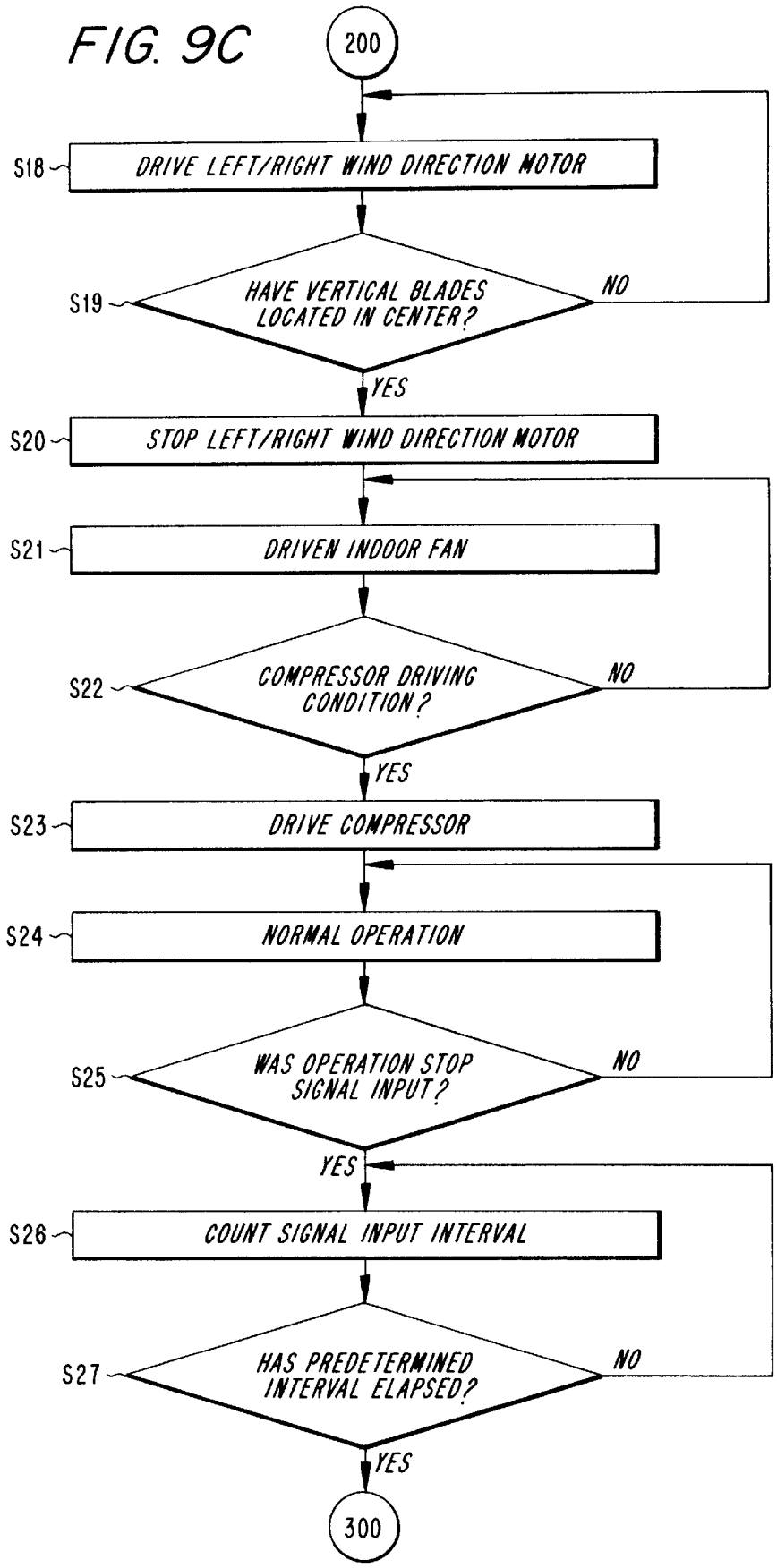
Figure 9D:
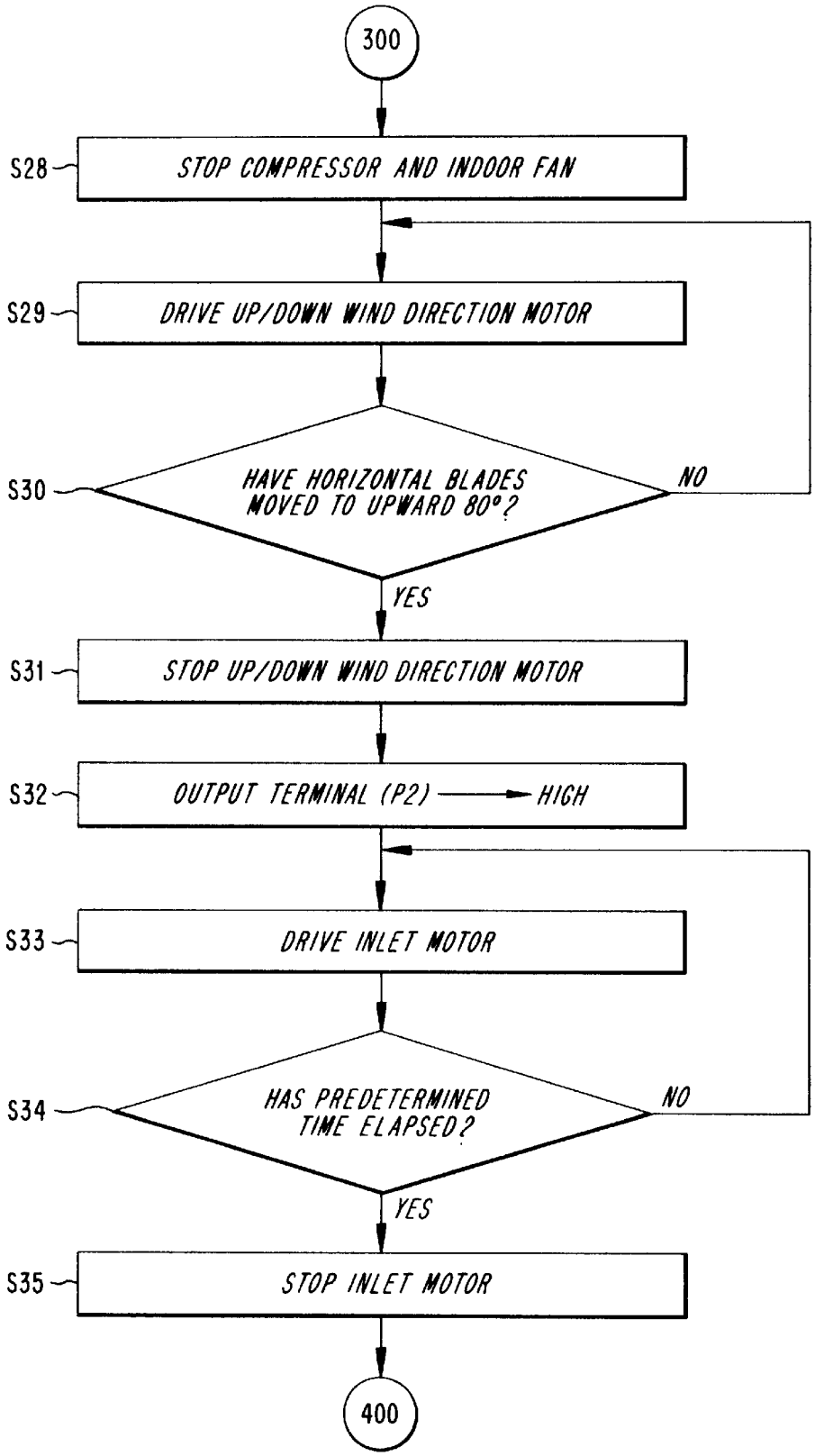
Figure 9E:
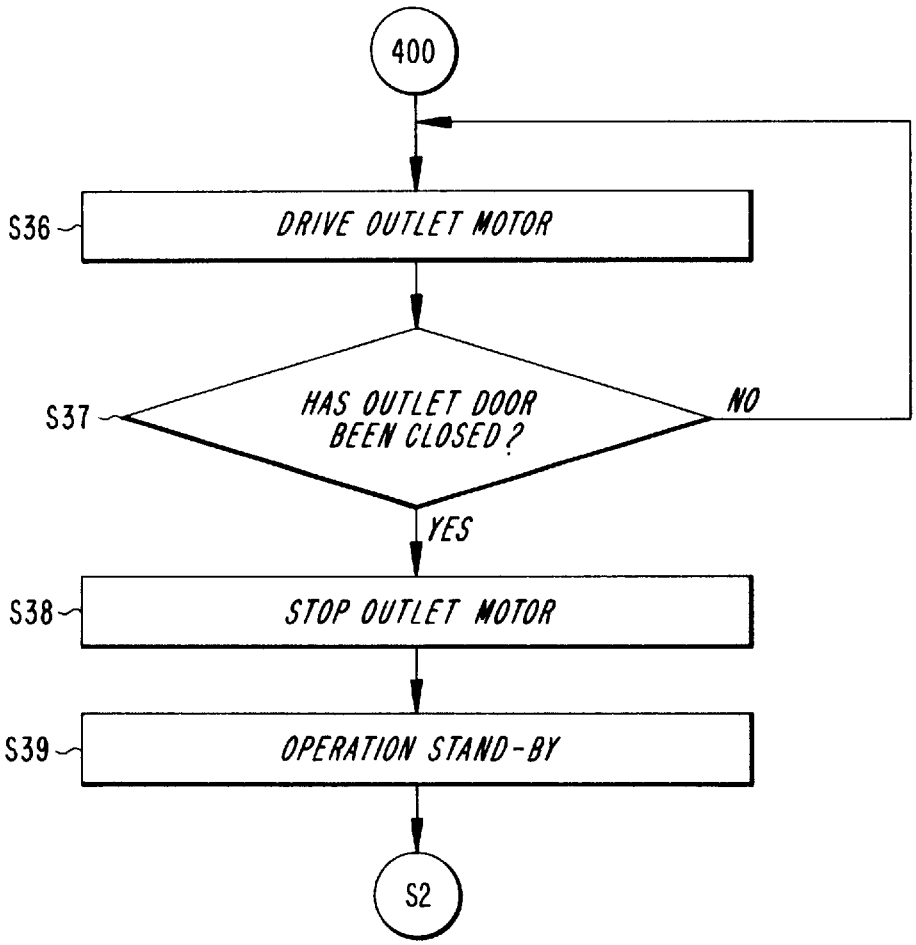

As shown FIGS. 7 and 8, a power supply means 100 serves to transform commercial A.C. voltage supplied from an A.C. power source 101 to a predetermined D.C. voltage necessary for operating the air conditioner. Operation manipulating means 102 is equipped with a start/stop key (hereinafter referred to as "start key") as well as a plurality of function keys for selecting drive modes (auto, cooling, defrosting, air blowing, heating or the like), wind amount of air discharged through the outlet 7 (strong wind, weak wind, breeze and the like) and desired temperature (Ts: hereinafter referred to as "established temperature").

A control means 104 is provided in the form of a microcomputer for initializing an operational condition of the air conditioner by receiving the D.C. voltage output from the power source 100 and controlling an overall operation of the air conditioner according to a selection signal input to the operation manipulating means 102. The control means 104 serves to control D.C. current applied to the inlet motor 31 for opening or closing the outlet door 13 and for opening or closing the inlet grill 34, and, at the same time, to count a door close-driving time duration of the inlet motor 31 to control a door close operation of the inlet grill 34.

Indoor temperature detecting means 106 detects a current indoor temperature (Tr) from the room air being inhaled through the inlet 3 in order to control the indoor temperature to an established temperature (Ts) by actuating the air conditioner. And outlet open/close driving means 108 receives a start/stop signal output from the control means 104 when an operation start or stop signal is input, and controls the driving of the outlet motor 21 to vertically move the outlet door 13.

Further, outlet open/close detecting means 110 senses whether the outlet 7 is opened or closed according to an open/close position of the outlet door 13 which is vertically moving according to operation of the outlet open/close driving means 108, and outputs the detected signal to the control means 104.

Inlet open/close drive means 112 receives a control signal output from the control means 104 when the operation start signal or the operation stop signal is input by the operation manipulating means 102 and also controls the driving of the inlet motor 31 in order to move the inlet grill 34 for opening and closing the inlet 3. The inlet open/close drive means 112 comprises an inverter IC 113 for reversing an open/close control signal of high level output from output terminals P1 and P2 of the control means 104, a relay RY1 being turned on by D.C. voltage (12V) output from the power supply means 100 in order to forward drive the inlet motor 31 when an open control signal of low level reversed by the inverter IC 113 is output, and a relay RY2 being turned on by D.C. voltage (12V) output from the power supply means 100 in order to reversely drive the inlet motor 31 when close control signal of low level reversed by the inverter IC 113 is output.

Inlet open detecting means 114 detects whether the inlet 3 has been opened by the inlet grill 34 according to a vertical position of the slide member 33 which moves upward in accordance with the driving of the inlet motor 31, and the inlet open detecting means 114 outputs a corresponding signal to the control means 104.

Further, wind direction control means 116 serves to control the direction of the air discharged through the outlet 7 vertically and horizontally so that the wind is spread all over the room. The wind direction control means 116 comprises an up/down wind direction control unit 118 for receiving a control signal output from the control means 104 and driving an up/down wind direction motor 119 so that the horizontal blades 9 move up and down vertically; and an left/right wind direction control unit 120 for receiving control signal output from the control means 104 and driving an left/right wind direction motor 121 so that the vertical blades 9 move left and right horizontally.

Compressor driving means 121 receives a control signal output from the control means 104 according to a difference between an established temperature (Ts) input by user and a room temperature (Tr) detected by the indoor temperature detecting means 106, and controls the driving of the compressor 123. Fan motor driving means 124 receives control signal output from the control means 104 to ventilate the air heat exchanged in the heat exchanger 37 to the room, and controls the R.P.M. of the indoor fan motor 39 to run the indoor fan 41.

In the accompanying drawings, display means 126 displays an operational condition of the air conditioner as well as operational selection mode (auto, cooling, defrosting, air blowing, heating or the like), an established temperature (Ts) and a current room temperature (Tr).

The operation of the operational control apparatus of the air conditioner described above will be explained.

FIGS. 9A to 9E are flow charts showing operational sequences of operational control of the air conditioner according to the present invention, and S in FIGS. 9A to 9E indicates each "step".

The inlet 3 and outlet 7 are assumed to be closed in the initial condition for explaining the operations of the air conditioner according to the present invention.

First, when power is applied to the air conditioner, a power supply means 100 transforms the commercial A.C. voltage supplied from a commercial A.C. power source 101 to a predetermined D.C. voltage necessary for driving the air conditioner and outputs it to both the driving circuit and the control means 104.

Accordingly, at step S1, the control means 104 receives the D.C. voltage from the power supply means 100 and initializes an operational condition of the air conditioner.

At this time, when a user manipulates the operation manipulating means 102 to input a desired operational mode (auto, cooling, defrosting, air blowing, heating or the like) of the air conditioner and a established temperature (Ts) and then press the start key, the operation manipulating means 102 inputs operational selection signal and operation start signal (hereinafter, referred to as "operation signal") to the control means 104.

As the result, at step S2, the control means determines whether the operation signal is input from the operation manipulating means 102 or not. If the operation signal is not input (in case of "NO"), the control means 104 maintains the air conditioner in an operation stand-by condition and repeats the steps S1 and S2.

If the operation signal is input (in case of "YES") at step S2, the control means 104 proceeds to the step S3 and a timer counts a time interval beginning when the operation signal is input.

At this time, at step S4, the control means 104 determines whether the counted time interval has passed a predetermined time (i.e., the minimal time interval for preventing frequent ON/OFF operations of the driving elements is about 3 seconds). If the counted time has not passed the predetermined time (in case of "NO"), it returns to the step S3 and repeats the foregoing steps 1 to 3.

If the counted time has passed the predetermined time (in case of "YES") at step S4, it determines that the operation signal is input normally and proceeds to step S5. The control means 104, at the step S5, outputs driving pulses to the up/down wind direction control unit 118 for moving the horizontal blades 9 upward to an out-of-the-way position so that the outlet door 13 is opened smoothly.

Accordingly, the up/down wind direction control unit 118 receives driving pulses output from the control means 104 and runs the up/down wind direction control motor 119, so that a plurality of link members 29 connected therewith are operated to rotate the horizontal blades 9 upward simultaneously.

At this time, at step S6, the control means 104 counts the number of pulses output when the up/down wind direction control motor 119 is driven and determines whether the horizontal blades 9 are tilted by 10° from horizontal in the upward direction.

The determination whether the horizontal blades 9 are moved 10° in the upward direction is possible by counting the number of pulses output from the control means 104 because the number of pulses for the horizontal blades 9 to be moved 10° in the upward direction has been set within the control means 104.

If the horizontal blades 9 are not rotated 10° in the upward direction (in case of "NO") at step S6, operation returns to the step S5 at which the control means 104 repeats the steps 1 to 5 while outputting the driving pulses to the up/down wind direction control unit 118 until the horizontal blades 9 travel 10° in the upward direction.

However, if the horizontal blades 9 are rotated 10° in the upward direction (in case of "YES") at step S6, operation proceeds to step S7 at which the up/down wind direction control unit 118 receives the driving pulses output from the control means 104 and stops driving the up/down wind direction control motor 119 thereby concluding the upward movement of the horizontal blades 9.

Next, at step S8, the control means 104 outputs a control signal of high level through an output terminal P1 to the inlet open/close driving means 112 in order to open the closed inlet 3.

Accordingly, the open control signal of high level output from the output terminal P1 of the control means 104 is inverted to that of low level through an inverter IC 113, and a relay RY1 is turned on by D.C. voltage (12V) output from power supply means 100 so that contacts points RY1*c* of the relay RY1 are closed.

If the contact points RY1*c* of the relay RY1 are closed, the A.C. voltage, at step S9, is applied from the A.C. current supply terminals 101 to coil 31*a* of the inlet motor 31 to run the inlet motor 31 in a forward direction. The pinion 32 coupled with the shaft of the inlet motor 31 is revolved, and the slide member 33 engaged with the pinion 32 ascends. As the slide member 33 ascends, the grooves 33*a* formed in the slide member 33 are moved upward. Further, as the grooves 33*a* ascend, protrusions 34*b* of the inlet grill 34 are rotated while guided by the arc shaped guide holes 35*b*, so that the inlet grill 34 is rotated by a determined angle to open the inlet 3.

And, at step S10, the control means 104 outputs a control signal for opening the closed outlet 7 to the outlet open/close driving means 108.

Accordingly, the outlet open/close driving means 108 drives the outlet motor 21 according to the control of the control means 104, so that the outlet motor 21 is driven forwardly and the pinion 23 coupled with the shaft 22 of the outlet motor 21 is revolved to move the rack 25 coupled therewith downward to thereby lower the outlet door 13 to open the outlet 7.

At this time, at step S11, an outlet open/close detecting means 110 detects a position of the outlet door 13 which is moved downward by the outlet motor 21, and an inlet open detecting means 114 detects an upper position of the slide member 33 which is moved upward by the inlet motor 31.

Accordingly, the control means 104 receives signals detected by the outlet open/close detecting means 110 and the inlet open detecting means 114, and determines whether the outlet door 13 and the inlet grill 34 are opened or not. If the outlet door 13 and the inlet grill 34 are not opened (in case of "NO"), operation returns to step S9 and the outlet motor 21 and the inlet motor 31 are driven until the outlet door 13 and the inlet grill 34 are opened.

If the outlet door 13 and the inlet grill 34 are opened (in case of "YES") at step S11, operation proceeds to step S12 at which the outlet open/close drive means 108 stops driving the outlet motor 21 according to the control of the control means 104 to thereby conclude the opening operation of the outlet door 13.

And the inlet open/close drive means 112 stops driving the inlet motor 31 according to the open control signal of low level output from the output terminals P1 of the control means 104 to conclude the opening operation of the inlet grill 34.

If the outlet door 13 and the inlet grill 34 are completely opened, the control means 104 outputs driving pulses to the up/down wind direction control unit 114 in order to move the horizontal blades 9 downwardly, thereby fixing the start point of movement of the horizontal blades 9 for a precise position control of the horizontal blades 9.

Accordingly, the up/down wind direction control unit 114 receives the drive pulses output from the control means 104 and drives the up/down wind direction motor 115, so that the plurality of link members 29 connected therewith are operated to downward rotate the horizontal blades 9 simultaneously.

At this time, at step S14, the control means 104 counts the number of pulses output when the up/down wind direction motor 115 is driven and determines whether the horizontal blades 9 reach the start position. If the horizontal blades 9 do not reach the start position (in case of "NO"), operation returns to step S13 and steps S1 to S13 are repeated until the horizontal blades 9 reach the start position.

If the horizontal blades 9 reach the start position (in case of "YES") at step S14, operation proceeds to step S15 at which the control means 104 outputs driving pulses for rotating the horizontal blades upwardly so that the horizontal blades 9 are located in the center with respect to the front, i.e., are oriented in horizontal planes.

Accordingly, the up/down wind direction control unit 114 receives the driving pulses output from the control means 104 and drives the up/down wind direction motor 115, so that the plurality of link members 29 connected therewith are operated to rotate the horizontal blades 9 simultaneously.

At this time, at step S16, the control means 104 counts the number of pulses output when the up/down wind direction motor 115 is driven and determines whether the horizontal blades 9 are oriented in the center position or not. If the horizontal blades 9 are not oriented in the center (in case of "NO"), operation returns to step S15 and steps S1 to S15 are repeated until the horizontal blades 9 are oriented in the center.

If the horizontal blades 9 are oriented in the center (in case of "YES") at step S16, operation proceeds to step S17 at which the up/down wind direction control unit 114 receives the driving pulses output from the control means 104 and stops the up/down wind direction motor 115 to conclude the orientation control operation of the horizontal blades 9.

Then, the control means 104 outputs to the left/right wind direction unit 120 the driving pulses for rotating the vertical blades 11 in the center with respect to the front, i.e., wherein the blade planes are perpendicular to the air outlet.

Accordingly, the left/right wind direction control unit 120 receives the driving pulse output from the control means 104 and drives the left/right wind direction motor 121 to rotate the plurality of vertical blades 11 to the center at the same time.

At this time, at step S19, the control means 104 counts the number of the driving pulses output when the left/right wind direction motor 121 is driven and determines whether the vertical blades 11 are oriented in the center or not. If the vertical blades 11 are not oriented in the center (in case of "NO"), operation returns to step S18 and steps 1 to 18 are repeated until the vertical blades 11 are oriented in the center.

If the vertical blades 11 are oriented in the center (in case of "YES") at step S19 operation proceeds to step S20 at which the left/right wind direction control unit 120 receives the driving pulses output from the control means 104 and stops the left/right wind direction motor 121 to conclude the orientation control operation of the vertical blades 9.

Then, at step S21, a fan motor driving means 124 drives the indoor fan 41 by controlling R.P.M. of the indoor fan motor 39 according to the control of the control means 104.

If the indoor fan 41 is driven, room air starts to be inhaled into the indoor unit 1 through the inlet 3. At this time, the indoor temperature detecting means 106 detects the indoor temperature (Tr) of the incoming air inhaled through the inlet 3.

Meanwhile, at step S22, the indoor temperature (Tr) detected by the indoor temperature detecting means 106 is compared with the established temperature (Ts) set in the operation manipulating means 102 by the user and it is determined whether the compressor 123 should be driven.

The condition that the compressor 123 should be driven is a condition wherein the indoor temperature (Tr) detected by the indoor temperature detecting means 106 is higher than the established temperature (Ts) set by the user for an air-cooling operation, or is a condition wherein the indoor temperature (Tr) detected by the indoor temperature detecting means 106 is lower than the established temperature (Ts) set by user for an air-warming operation.

If the condition does not correspond to a condition that the compressor 123 should be driven (in case of "NO") at step S22, operation returns to step S21 and steps S1 to S21 are repeated while detecting the indoor temperature (Tr). If the condition corresponds the compression that the compressor 123 should be driven (in case of "YES"), operation proceeds to step S23 at which the control means 104 determines driving frequency of the compressor 123 according to a difference between the indoor temperature (Tr) and the established temperature (Ts) and outputs a control signal for driving the compressor 123 to the compressor driving means 122.

Accordingly, the compressor driving means 122 drives the compressor 123 according to a driving frequency determined at the control means 104.

If the compressor 123 is driven, the indoor fan 41 is driven at the step S24 and the room air is inhaled into the indoor unit 1 through the inlet 3. The incoming air inhaled into the indoor unit 1 through the inlet 3 is warmed or cooled while passing through the heat exchanger 37.

The warm or cool air from the heat exchanger 37 is moved upward and is discharged to the room with the wind direction controlled up/down and left/right according to the wind direction angle of the horizontal blades 9 and the vertical blades 11.

Whether the operation key of the drive manipulation means 102 becomes turned off and the operation stop signal is input or not is determined at step S25 while the air conditioner is in normal operation as above. If operation stop signal is not input (in case of "NO"), operation returns to step S24 and steps S1 to S24 are repeated while accomplishing normal operation. If an operation stop signal is input (in case of "YES") at step S25 operation proceeds to step S26 at which the control means 104 counts the signal input interval when the operation stop signal is input, i.e., counts a time beginning with the inputting of the stop signal.

At this time, at the step S27, whether the signal input interval counted by the control means 104 has passed the predetermined time interval (about 3 seconds) is determined. If the predetermined time interval has not been elapsed (in case of "NO"), operation returns to step S26 and steps S1 to S26 are repeated until the predetermined time interval has elapsed.

If the determined time interval has elapsed (in case of "YES") at step S27, it is determined that the operation stop signal has been input normally and operation proceeds to step S28, so that the control means 104 outputs the control signal for stopping the compressor 123 and the indoor fan motor 39 to both the compressor driving means 122 and the fan motor driving means 124.

Accordingly, the compressor driving means 122 stops the compressor 123 according to the control of the control means 104, and the fan motor driving means 124 stops the indoor fan motor 39 according to the control of the control means 104.

Then, at step S29, the control means 104 outputs driving pulses for rotating the horizontal blades 9 upward to an out-of-the-way position so that the outlet door 13 is operated smoothly during a closing operation.

Accordingly, the up/down wind direction control unit 118 receives the driving pulses output from the control means 104 and drives the up/down wind direction control motor 119, so that a plurality of link members 29 coupled therewith are operated to tilt the horizontal blades 9 upward simultaneously.

At this time, at step S30, the control means 104 counts the number of pulses output when the up/down wind direction control motor 119 is driven and determines whether the horizontal blades 9 are inclined by 80° from horizontal in upward direction. If the horizontal blades 9 do not reach 80° in the upward direction (in case of "NO"), operation returns to the step S29 and steps S1 to S29 are repeated until the horizontal blades 9 reach 80° in the upward direction.

However, if the horizontal blades 9 are moved to the 80° position in upward direction (in case of "Yes") at step S30, operation proceeds to step S31, wherein the up/down wind direction control unit 118 receives the driving pulses output from the control means 104 and stops driving the up/down wind direction control motor 119 and, therefore, concludes the upward orientation of the horizontal blades 9.

Next, at step S32, the control means 104 outputs a control signal of high level through an output terminal P2 to the inlet open/close driving means 112 in order to close the opened inlet 3.

Accordingly, the control signal of high level output from the output terminal P2 of the control means 104 is inverted to low level through an inverter IC 113, and a relay RY2 is turned on by D.C. voltage (12V) output from power supply means 100 so that contact points RY2*c* of the relay RY2 become closed.

If the contact points RY2*c* of the relay RY2 are closed, the A.C. voltage from A.C. supply terminals 101 is applied to coil 31*b* of the inlet motor 31 to drive the inlet motor 31 in reverse direction at step S33. Then, the pinion 32 coupled with the shaft of the inlet motor 31 is revolved reversely, the slide member 33 engaged with a side of the pinion 32 descends and the slot grooves 33*a* formed in the slide member 33 move downward as the slide member 33 is descending. As the grooves 33*a* are descending, the protrusions 34*b* of the inlet grill 34 are rotated while being guided by the arc shaped guide holes 35*b*, so that the inlet grill 34 is rotated by a predetermined angle to close the inlet 3.

At this time, at step S34, the control means 104 counts the time duration of the inlet motor 31 operation and determines whether a predetermined time duration (data produced through experiments for the time necessary for closing the inlet grill, about 11.5 seconds) has elapsed. If the predetermined time duration has not elapsed (in case of "NO"), operation returns to the step S33 and the inlet motor 31 is driven until the inlet grill 34 becomes closed.

If the predetermined time duration has elapsed (in case of "YES") at the step S34, it is determined that the inlet grill 34 is completely closed and operation proceeds to step S35 at which the inlet open/close driving means 112 stops driving the inlet motor 31 to conclude the closing operation of the inlet grill 34.

Then, at step S36, the control means 104 outputs the control signal for closing the opened outlet 7 to the outlet open/close driving means 108.

Accordingly, the outlet open/close driving means 108 drives the outlet motor 21 according to the control of the control means 104. The outlet motor 21 is driven reversely and the pinion 23 coupled with the shaft 22 of the outlet motor 21 is revolved to move the rack 25 and the outlet door 13 upwardly to close the outlet 7.

At this time, at step S37, an outlet open/close detecting means 110 detects the position of the outlet door 13 which is moved upward by the outlet motor 21 and, the control means 104 receives the signal detected by the outlet open/close detecting means 110 to determine whether the outlet door 13 is closed or not.

If the outlet door 13 and the inlet grill 34 are not closed (in case of "NO") at step S37, operation returns to step S3G and continues to drive the outlet motor 21 until the outlet door 13 is completely closed. If the outlet door 13 is closed (in case of "NO"), operation proceeds to step S38 at which the outlet open/close drive means 108 stops driving the outlet motor 21 according to the control of the control means 104 to conclude the closing operation of the outlet door 13.

Meanwhile, the operation of the inlet motor 31 in the steps S33–S35 and the operation of the outlet motor 21 in the steps S36–S38 are accomplished simultaneously, but have been described sequentially for explanation convenience only.

In succession, at step S39, the control means 104 returns to step S2 and repeats steps S1 and S2 while maintaining an operational stand-by condition until the operation signal is input again by the operation manipulating means 102.

As described as above, the operational control apparatus and method therefor according to the present invention prevent the driving elements from being intermittently operated according to frequent ON/OFF inputs to thereby reduce noise generation and prolong the life of driving elements and the air conditioner as well, and to eliminate interferences between the horizontal blades 9 and the outlet door 13 by tilting the horizontal blades 9 upward in advance before the outlet 7 is opened or closed so as to facilitate the opening and closing operation of the outlet door 13, and to control the direction of the discharged air effectively by positioning the wind direction guiding blades 9 and 11 centrally when the outlet 7 becomes opened.

What is claimed is:

1. An air conditioner comprising:

a body forming an air inlet and an air outlet;

a heat exchanger in the body for changing a temperature of air passing from the inlet to the outlet;

wind direction guiding blades arranged across the outlet for controlling a direction of air discharged through the outlet;

a first motor-driven mechanism connected to the wind direction guiding blades for adjusting the blade orientation and the direction of air travel;

a door mounted on the body and movable for opening and closing the outlet;

a second motor-driven mechanism connected to the door for moving the door between open and closed positions;

an input panel enabling a user to input operating modes and operation start/stop signals;

a controller connected to the input panel, and the to first and second motor-driven mechanisms for operating the first and second motor-driven mechanisms; and a timer connected to the input panel and controller for counting a time interval beginning with the inputting of an operation start signal or an operation stop signal for preventing the controller from starting or stopping the operation of the air conditioner until a predetermined time interval has elapsed;

the control mechanism being operable to orient the wind direction guiding blades in a position avoiding obstruction of movement of the door after the predetermined time interval has elapsed and before the door is opened or closed.

2. A method for operating an air conditioner, the air conditioner comprising a body forming an air inlet and an air outlet; a heat exchanger in the body for changing a temperature of air passing from the inlet to the outlet; wind direction guiding blades arranged across the outlet for controlling a direction of air discharged through the outlet; a first motor-driven mechanism connected to the wind direction guiding blades for adjusting the blade orientation and the direction of air travel; a door mounted on the body and movable for opening and closing the outlet; a second motor-driven mechanism connected to the door for moving the door between open and closed positions; an input panel enabling a user to input operating modes and start/stop signals; a controller connected to the input panel, and to the first and second motor-driven mechanisms for operating the first and second motor-driven mechanisms; and a timer connected to the input panel and controller for counting a time interval; the method comprising the steps of:

A) causing the timer to count a time interval following the inputting of a start or an operation start signal or an operation stop signal;

B) delaying the starting or stopping of the air conditioning operation until a predetermined time interval has lapsed; and C) orienting the wind direction guiding blades in a position avoiding obstructing a movement of the door following the elapse of the predetermined time interval and prior to opening or closing the door.

* * * * *